US006985130B2

(12) United States Patent
Nakayoshi et al.

(10) Patent No.: US 6,985,130 B2
(45) Date of Patent: Jan. 10, 2006

(54) DISPLAY DEVICE INCLUDING A DISTRIBUTION CIRCUIT DISPOSED AFTER A VIDEO SIGNAL GENERATION CIRCUIT

(75) Inventors: Yoshiaki Nakayoshi, Ooamishirasato (JP); Kazuhiko Yanagawa, Mobara (JP)

(73) Assignee: Hitachi, Ltd., Tokyo (JP)

( * ) Notice: Subject to any disclaimer, the term of this patent is extended or adjusted under 35 U.S.C. 154(b) by 162 days.

(21) Appl. No.: 10/270,295

(22) Filed: Oct. 15, 2002

(65) Prior Publication Data

US 2003/0085885 A1 May 8, 2003

(30) Foreign Application Priority Data

Nov. 8, 2001 (JP) ..... 2001-342657

(51) Int. Cl.
*G09G 3/36* (2006.01)

(52) U.S. Cl. ..... 345/100; 345/96; 345/98

(58) Field of Classification Search ..... 345/96, 345/98, 100, 76, 88

See application file for complete search history.

(56) References Cited

U.S. PATENT DOCUMENTS

| | | | | |
|---|---|---|---|---|
| 5,781,168 | A * | 7/1998 | Osada et al. | 345/76 |
| 6,424,328 | B1 * | 7/2002 | Ino et al. | 345/87 |
| 6,556,181 | B2 * | 4/2003 | Yamada et al. | 345/88 |

FOREIGN PATENT DOCUMENTS

| | | |
|---|---|---|
| JP | 11-249627 | 3/1998 |
| JP | 11-327518 | 8/1998 |
| JP | 2001-109435 | 10/1999 |

* cited by examiner

*Primary Examiner*—Sumati Lefkowitz
*Assistant Examiner*—Rodney Amadiz
(74) *Attorney, Agent, or Firm*—Reed Smith LLP; Stanley P. Fisher, Esq.; Juan Carlos A. Marquez, Esq.

(57) ABSTRACT

In an image display device including a distribution circuit disposed after a video signal generation circuit, mutually adjacent outputs from the video signal generation circuit are made opposite to each other in polarity, and at least one of R, G and B colors assigned to one unit pixel each including three mutually adjacent R, G and B pixels is connected to the video signal generation circuit different from the video signal generation circuit to which the other ones of the R, G and B colors are connected.

2 Claims, 15 Drawing Sheets

DISPLAY DEVICE INCLUDING A DISTRIBUTION CIRCUIT DISPOSED AFTER A VIDEO SIGNAL GENERATION CIRCUIT

BACKGROUND OF THE INVENTION

1. Field of the Invention

The present invention relates to an image display device.

2. Description of the Related Art

To cope with greater demands for lower-price higher-resolution image display devices, there are known arts in which part or the whole of a peripheral circuit is constructed on a TFT substrate of an image display device, with a high-performance semiconductor such as polysilicon of higher mobility than conventional amorphous silicon. Two major arts are known: one is an art in which a video signal generation circuit itself is formed of such a high-performance semiconductor on a TFT substrate; and the other is an art in which a video signal generation circuit is constructed of semiconductor chips and a distribution circuit made of such a high-performance semiconductor is provided after the video signal generation circuit on a TFT substrate, and each output from the video signal generation circuit is branched by the distribution circuit, whereby a reduction in the number of semiconductor chips to be used is realized.

SUMMARY OF THE INVENTION

In the former art, if the distribution circuit is not provided, a problem due to branching in principle does not occur. However, in the former or latter art, if a signal from the distribution circuit is branched, a new problem occurs, i.e., the problem of how to control the polarity of a display signal to be applied to each pixel of a screen by branching.

In terms of the necessity of reducing smears and flickers in a display image, so-called dot inversion which applies signals of different polarity to adjacent pixels is widely known to be desirable, and is also widely used. As a matter of course, even in a liquid crystal display device having a distribution circuit, such dot inversion can be realized by changing the polarity of output signals from a video signal generation circuit at high speed in synchronism with the operation of the distribution circuit. However, in an example in which one output from a video signal generation circuit is distributed among three branch signal lines by a distribution circuit, the polarity of output signals from the distribution circuit needs to be changed at a speed three times as high as that in a construction containing no distribution circuit, so that a high-performance distribution circuit is needed, resulting in an increase in cost. In addition, since the video signal generation circuit is reversed in polarity at a three-fold frequency, an increase in power consumption results. Moreover, a certain period of time is taken until the outputs from the distribution circuit pass through the distribution circuit and potentials supplied to individual signal lines become stable, and the time required for this potential stabilization depends on the previous output voltages from the video signal generation circuit. If the video signal generation circuit continuously outputs the same level of voltage, the potentials become stable in an extremely short time. On the other hand, in the case where the video signal generation circuit outputs voltages with a large voltage difference, it takes time for each of the potentials to become stable. Particularly when the output voltages are reversed in polarity, a very long time is needed. Accordingly, in the example of the distribution of one voltage output among three branch signal lines, it is desirable that three branch output voltages be of the same polarity until the distribution circuit completes one cycle of branching operations.

As one art of solving the above-described problem, Japanese Patent Laid-Open No. 249627/1999 is publicly known. Japanese Patent Laid-Open No. 249627/1999 discloses a construction in which source drivers are provided on the opposite sides of the display area of a liquid crystal display device with a distribution circuit in such a manner that the source drivers are of mutually opposite polarity to realize dot inversion.

However, this construction has the problem that source-driver mounting areas need to be provided on the opposite sides and a space outside the effective display area is difficult to reduce. In addition, there is the problem that since all the circuits within the source drivers are driven in the same polarity, the polarity of power consumption of the source drivers switches every frame and a relatively large amount of current is needed during polarity switching, so that the scale of a power source circuit increases, incurring an increase in cost. Furthermore, it has been found out that since video signals are supplied along adjacent video signal lines DL in mutually opposite directions, the waveform delays of the adjacent video signal lines DL differ, so that a brightness difference may occur between every vertical signal line.

Furthermore, it has been found out that smears worsen during the display of a smear pattern (a black or white box-shaped pattern displayed on a half-tone background picture).

One advantage of this invention is realize an image display device having a distribution circuit capable of realizing dot inversion driving with high display image quality.

Principal examples of constructions according to the present invention will be described below.

(1) In an image display device including a distribution circuit disposed after a video signal generation circuit, mutually adjacent outputs from the video signal generation circuit are made opposite to each other in polarity and at least one of R, G and B colors assigned to one unit pixel each including three mutually adjacent R, G and B pixels is connected to an output of the video signal generation circuit different from an output of the video signal generation circuit to which the other ones of the R, G and B colors are connected.

(2) In an image display device including a distribution circuit disposed after a video signal generation circuit, at least one of R, G and B colors assigned to one unit pixel each including three mutually adjacent R, G and B pixels is connected to an output of the video signal generation circuit different from an output of the video signal generation circuit to which the other ones of the R, G and B colors are connected.

(3) In an image display device as in (1) or (2), the distribution circuit selects one of the mutually adjacent outputs from the video signal generation circuit for each of the R, G and B colors.

(4) In an image display device as in (1) or (2), the mutually adjacent outputs from the video signal generation circuit are provided as signals corresponding to mutually different colors.

(5) In an image display device as in any of (1) to (4), signals to be supplied from the distribution circuit to pixels corresponding to the respective R, G and B colors are in different order between adjacent scanning lines.

(6) In an image display device as in any of (1) to (4), signals to be supplied from the distribution circuit to pixels corresponding to the respective R, G and B colors are in different order between adjacent frames.

(7) In an image display device as in any of (1) to (6), a scanning signal has an ON state during a selection period of the distribution circuit.

(8) In an image display device as in any of (1) to (6), an effective display area of the image display device is made of liquid crystal elements.

(9) In an image display device as in any of (1) to (7), wherein an effective display area of the image display device is made of organic electroluminescent elements.

Further constructions of the invention will become apparent from the following description of preferred embodiments of the invention.

BRIEF DESCRIPTION OF THE DRAWINGS

The invention will become more readily appreciated and understood from the following detailed description of preferred embodiment of the invention when taken in conjunction with the accompanying drawings, in which.

DETAILED DESCRIPTION

Preferred embodiments of the invention will be described below in detail with reference to representative structures each of which embodies features of the invention.

(Embodiment 1)

Figure 1:
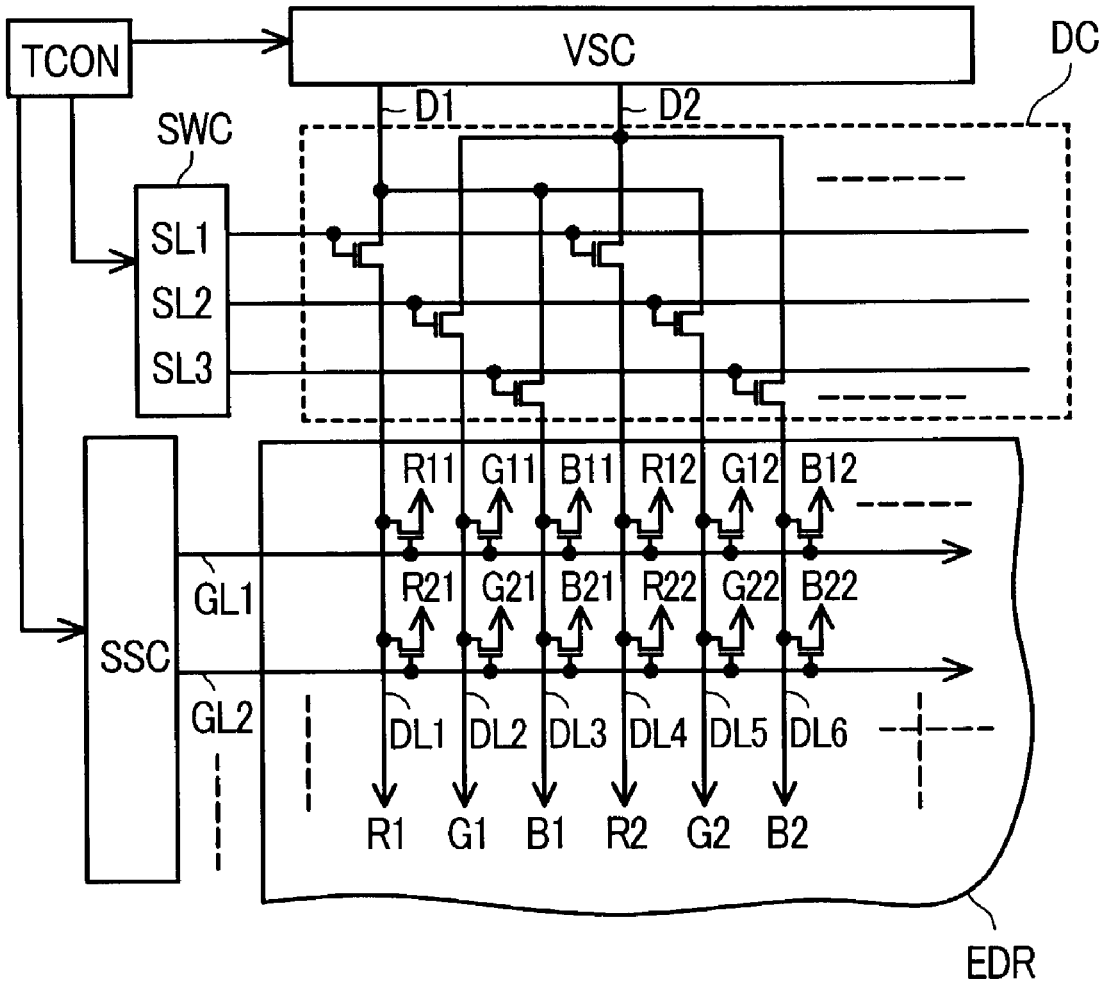
FIG. 1 is a schematic circuit diagram of an image display device according to Embodiment 1 of the invention.

FIG. 1 is a schematic circuit diagram showing the circuit of an image display device including a distribution circuit DC. Embodiment 1 is the same as Japanese Patent Laid-Open No. 249627/1999 in that each output from a video signal generation circuit VSC branches into a plurality of signal lines in the distribution circuit DC, but in Embodiment 1, the video signal generation circuit VSC is disposed on only one side of the image display device. Each of the branch outputs of the distribution circuit DC is connected to a corresponding one of video signal lines DL, and the outputs from the video signal generation circuit VSC are arranged so that the polarity of each of the outputs is reversed with respect to that of an adjacent one.

In the case where each of the outputs from the video signal generation circuit VSC is distributed among three branch signal lines, if adjacent three branch signal lines are directly connected to the corresponding ones of the video signal lines DL in the manner of, for example, D1→(R1, G1, B1) and D2→(R2, G2, B2) as viewed in FIG. 1, the polarities of the respective output signals R1, G1, B1, R2, G2 and B2 will become +, +, +, −, −, and −, which means that polarity reversal cannot be effected. For this reason, in Embodiment 1, data for adjacent output signals are stored in a memory of a timing converter TCON so that the order of supply of video signals is changed to realize polarity reversal in the manner of +, −, +, −, +, and − for the respective output signals R1, G1, B1, R2, G2 and B2. The memory may be provided in the video signal generation circuit VSC.

In FIG. 1, each of the adjacent outputs (D1 and D2 are representatively shown) from the video signal generation circuit VSC is distributed to three branch signal lines by the distribution circuit DC. A feature of Embodiment 1 resides in the connection of the video signal lines DL which are the three branch signal lines, and the output D1 is connected to the video signal lines DL (R1, B1 and G2), while the output D2 is connected to the video signal lines DL (G1, R2 and B2). Which of the video signal lines DL each of the outputs D1 and D2 is to be supplied to is determined as follows: A switching circuit SWC selectively applies an ON potential to any one of output terminals SL1, SL2 and SL3 and an OFF potential to the others in accordance with an instruction from the timing converter TCON, whereby a one-to-one correspondence is produced between each of the outputs D1 and D2 and the video signal lines DL and a video signal is supplied to a selected one of the video signal lines DL.

As one example, the order of data to be sent to the output D1 is set to R1, G2 and B1 and the order of data to be sent to the output D2 is set to R2, G1 and B2; that is to say, video signal lines to which to output the respective data G are switched therebetween, whereby the above-described polarity reversal can be realized. At this time, the video signals may be outputted as follows:

D1→R1 and D2→R2 for SL1:ON, SL2:OFF and SL3: OFF;

D1→G2 and D2→G1 for SL1:OFF, SL2:ON and SL3: OFF; and

D1→B1 and D2→B2 for SL1:OFF, SL2:OFF and SL3: ON.

Figure 2:
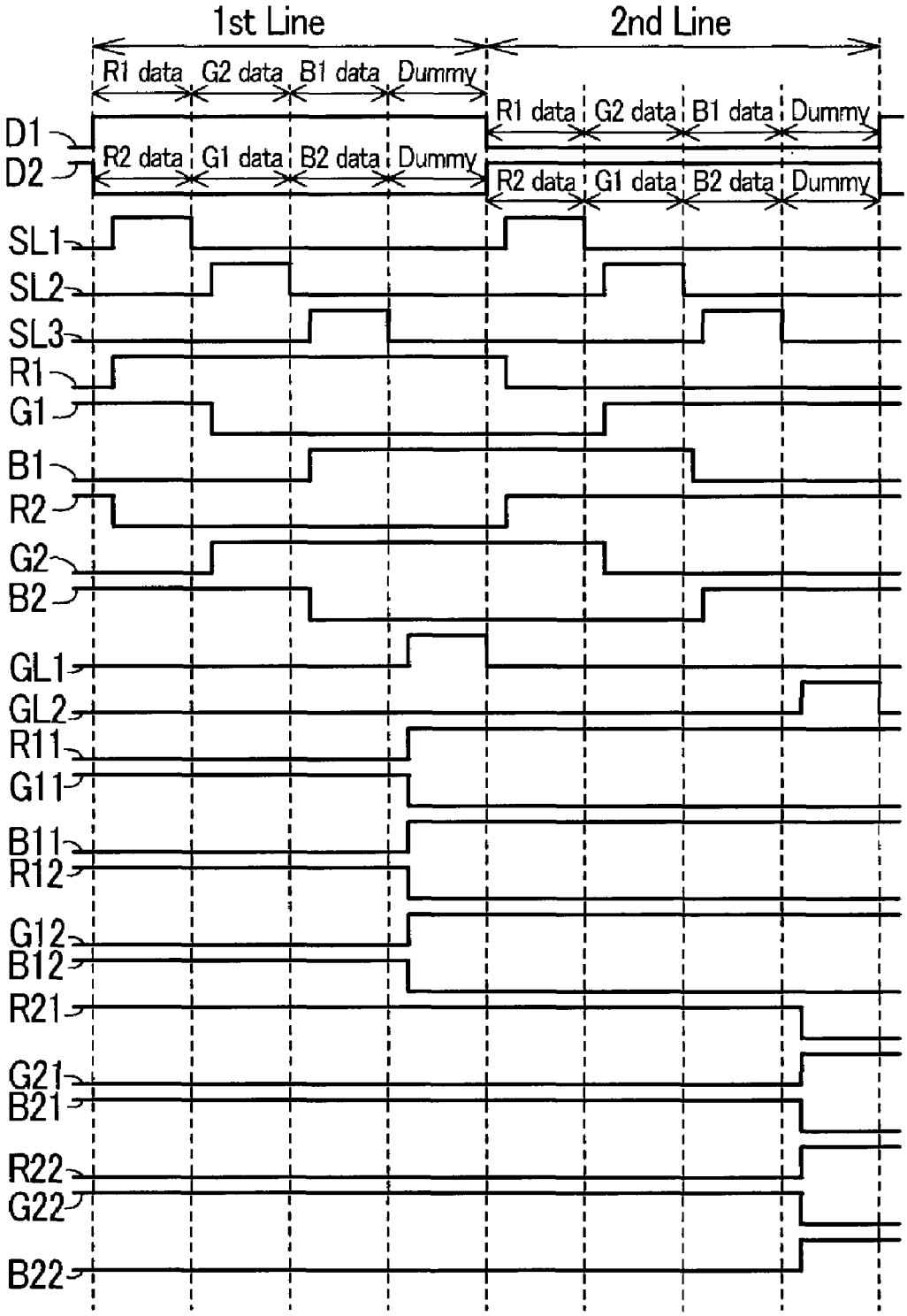
FIG. 2 is an explanatory view showing the signal polarity of the image display device according to Embodiment 1 of the invention.

Essential examples of the signal polarity used in the circuit shown in FIG. 1 are shown in FIG. 2. The symbols shown in FIG. 2 correspond to those shown in FIG. 1, respectively. FIG. 2 shows the manner in which video signals are respectively written to twelve pixels denoted by R11 to B22 in FIG. 1 in accordance with scanning signals supplied from two scanning signal lines GL1 and GL2. From FIG. 2, it can be understood that potentials of opposite polarity are respectively written to mutually adjacent ones of the pixels.

An XGA display device will be described below by way of example. The outputs D of the video signal generation circuit VSC of an XGA display device include at least outputs D1 to D1024 in the case of three-branch distribution. During one frame (FRM) period, (1) data for video signal lines R1 to R1024 are written to the respective video signal lines R1 to R1024 in accordance with the output from the terminal SL1, (2) data for video signal lines G1 to G1024 are written to the respective video signal lines G1 to G1024 in accordance with the output from the terminal SL2, (3) data for video signal lines B1 to B1024 are written to the respective video signal lines B1 to B1024 in accordance with the output from the terminal SL3, and (4) the scanning signal line GL1 is set to its ON level to write an image to the first line of pixels. In this manner, the video signals are written to the first line of pixels.

A similar operation is repeated from the scanning signal line GL2 to a scanning signal line GL768, whereby video signals can be written to all the pixels so that video signals of opposite polarity are respectively written to mutually adjacent ones of the pixels. Incidentally, the term "polarity" used herein means polarity which is determined with respect to the neutral point between the maximum and minimum possible voltages. The accompanying drawings are for illustration purposes only and are intended to show polarity relationship, but are not intended to show the absolute values and the time axes of individual voltages on an accurate scale.

Dummy pixels and/or dummy signal lines may be provided outside an effective display area EDR, and the idea of the invention disclosed herein may be applied to the dummy pixels and/or the dummy signal lines so that each of the dummy pixels and/or signal lines are driven to be reversed in polarity with respect to an adjacent one of effective pixels or signal lines. In this case, it is possible to efficiently restrain capacitive coupling in a peripheral portion of the effective display area EDR or brightness variations in the peripheral portion due to the penetration of an electric field.

In FIG. 2, a dummy period is provided in each frame (FRM) period, and video signals are written during the dummy period in accordance with a scanning signal from the corresponding one of the scanning lines GL. In this manner, driving conditions for R, G and B colors are uniformized to avoid generation of irregularity of the R, G and B colors.

As described above, in FIG. 2, there is shown that the polarity reversal of the adjacent output signals (represented by D1 and D2) from the video signal generation circuit VSC is realized between mutually adjacent pixels through the rearrangement of R, G and B data. Accordingly, a video signal can be written to each pixel so that the polarity of each pixel is reversed with respect to those of vertically and laterally adjacent pixels.

The video signal generation circuit VSC shown in FIG. 1 may also be formed outside a TFT substrate SUB1 by a TCP method, and video signals may be introduced into the lines D1 and D2 through terminals (not shown). A COG chip may also be mounted on a substrate, or may also be formed on the TFT substrate SUB1. It is desirable that a scanning signal generation circuit SCC be formed on a substrate. This is in part because the outside dimensions of the effective display area EDR can be reduced, and in part because terminal regions are not needed between the scanning signal generation circuit SCC and the scanning lines GL and waveform delay is decreased, as compared with the case where the scanning signal generation circuit SCC is provided outside the substrate.

In Embodiment 1, the video signal generation circuit VSC needs only to be provided on one side of the substrate. Accordingly, a reduction in mounting space is realized, whereby a liquid crystal display device having a large effective display area EDR compared to its external shape can be realized.

In the video signal generation circuit VSC, since polarity is reversed between mutually adjacent amplifiers, mutual cancellation of electromagnetic radiation interference is realized.

In addition, since the video signal generation circuit VSC provides positive outputs and negative outputs by approximately the same number, it is possible to prevent unstable operation of a power source due to the imbalance of output polarity or sharp reversal of polarity, thereby enabling a further improvement in image quality.

In addition, since the signal writing directions of the respective video signal lines DL are the same, the occurrence of bright irregularity between the video signal lines DL can be prevented.

In the construction of Embodiment 1, the layout of selecting TFT elements in the distribution circuit DC is realized as a regular layout of RGB units. Since a defect in the selecting TFT elements causes a line defect and hence a complete defect, a layout pattern which allows easy correction for disconnection and short-circuiting is desirable in order to realize high yield.

In Embodiment 1, owing to the regular layout pattern, the TFT elements can be easily corrected for defects, whereby an improvement in yield is realized.

(Embodiment 2)

Figure 3:
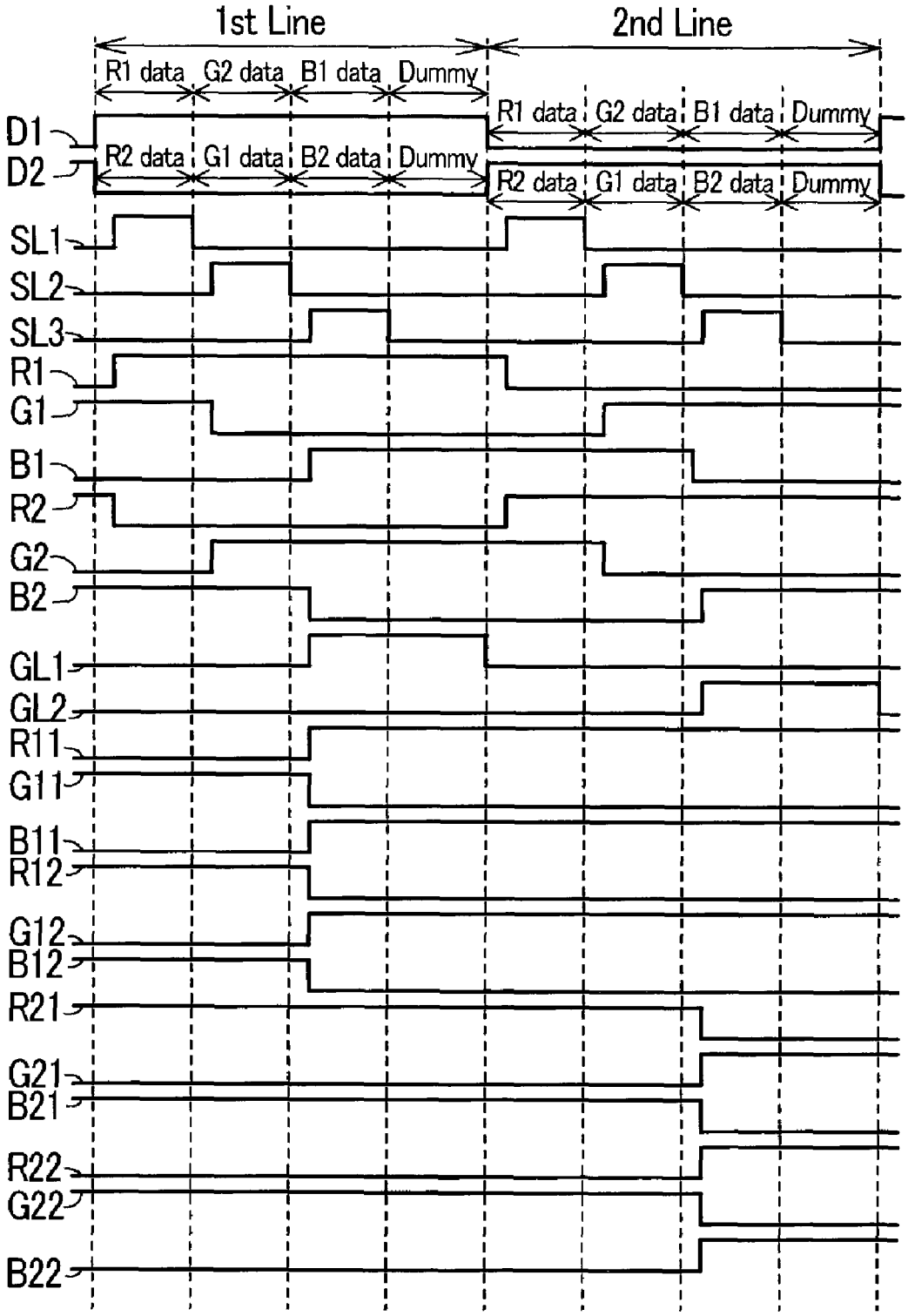
FIG. 3 is an explanatory view showing the signal polarity of the image display device according to Embodiment 2 of the invention.

FIG. 3 is a view corresponding to FIG. 2 which shows Embodiment 1.

The difference between Embodiment 2 and Embodiment 1 resides in the timing when each of the scanning lines GL goes to the ON level. Namely, during the period that video signals are being sent to the outputs D, a corresponding one of the scanning lines GL is set to its ON level before the dummy period.

Accordingly, as compared with the case where each of the scanning lines GL is held at the ON level during only the dummy period, the period of signal writing can be increased to facilitate the adaptation of the image display device to larger screens and higher resolutions.

The idea of setting the scanning line GL to the ON level before the dummy period during the period in which video signals are being sent out to the outputs D is not limited to the layout shown in FIG. 1 nor the signals shown in FIGS.

2 and 3, and can also be applied to any construction that has the distribution circuit DC after the video signal generation circuit VSC so that after a video signal has been supplied to each video signal line DL from the distribution circuit DC, a selected one of the scanning lines GL is set to the ON level to write the video signals to the corresponding pixels. In this construction as well, it is possible to achieve the advantage that the period of signal writing can be increased to facilitate the adaptation of the image display device to larger screens and higher resolutions.

(Embodiment 3)

Figure 4:
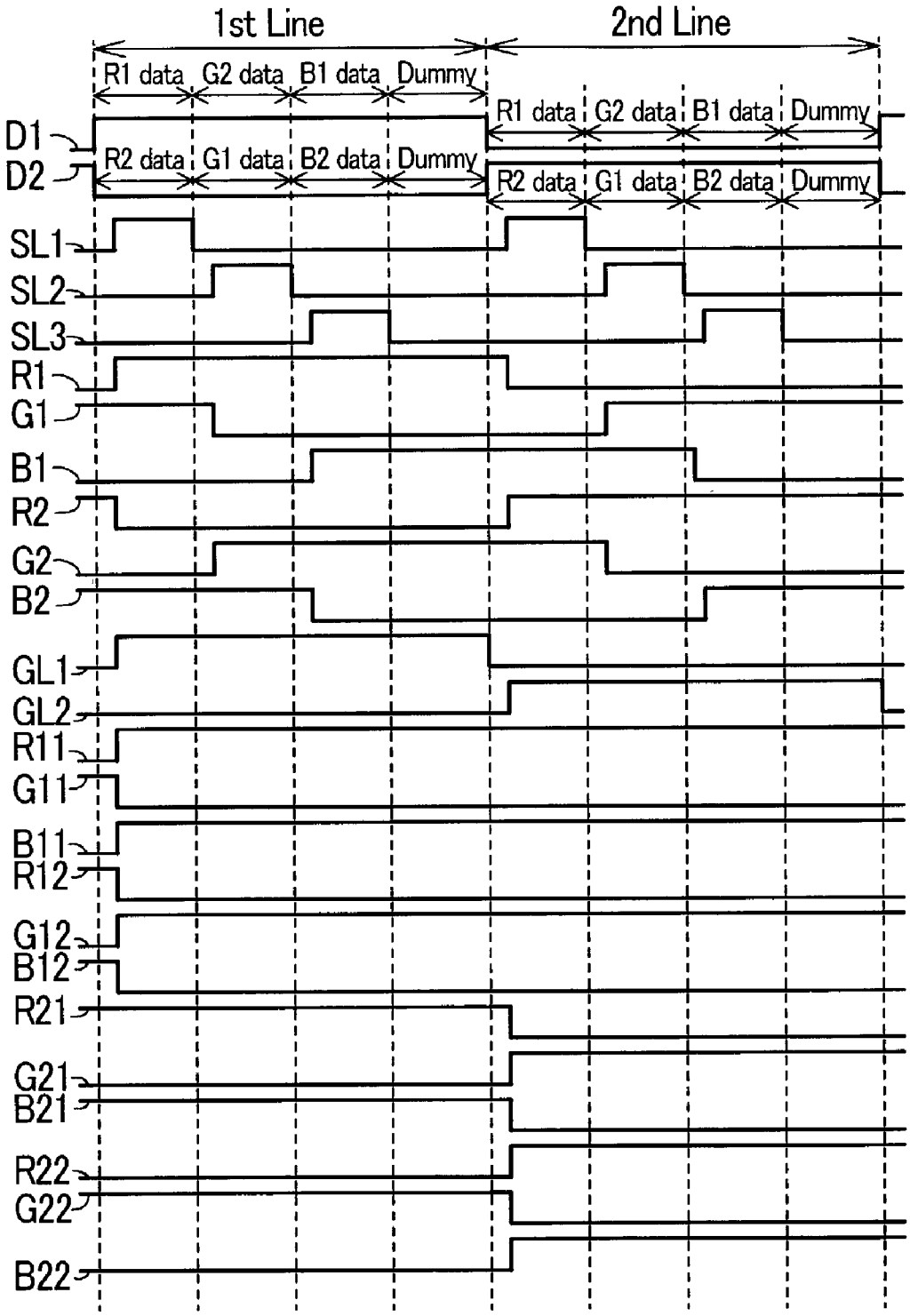
FIG. 4 is an explanatory view showing the signal polarity of the image display device according to Embodiment 3 of the invention.

FIG. 4 is a view corresponding to FIG. 2 which shows Embodiment 1.

The difference between Embodiment 3 and Embodiment 1 resides in the timing when each of the scanning lines GL goes to the ON level; that is to say, during the period of writing of video signals, a corresponding one of the scanning lines GL is set to the ON level before the dummy period.

As compared with the case where the scanning line GL is held at the ON level during only the dummy period, the period of signal writing can be increased to facilitate the adaptation of the image display device to larger screens and higher resolutions. The level of a voltage to be written to each actual pixel is determined at the time when the corresponding one of the scanning lines GL goes to its OFF level, and as a longer period of time passes until the scanning line GL goes to the OFF level, more stable writing is realized.

Accordingly, in Embodiment 3, for the purpose of maximizing the period of signal writing to adapt the image display device to far larger screens, the scanning line GL is held at the ON level for the transmission period of data for a plurality of colors.

The idea of holding the scanning line GL at the ON level for the transmission period of data for a plurality of colors is not limited to the layout shown in FIG. 1 nor the signals shown in FIG. 4, and can also be applied to any construction that has a branch circuit after the video signal generation circuit VSC so that after a video signal has been supplied to each video signal line DL from the branch circuit, the scanning line GL is set to the ON level to write the video signals to the respective pixels. In this construction as well, it is possible to achieve the advantage that the period of signal writing can be increased to facilitate the adaptation of the image display device to larger screens and higher resolutions.

(Embodiment 4)

Figure 5:
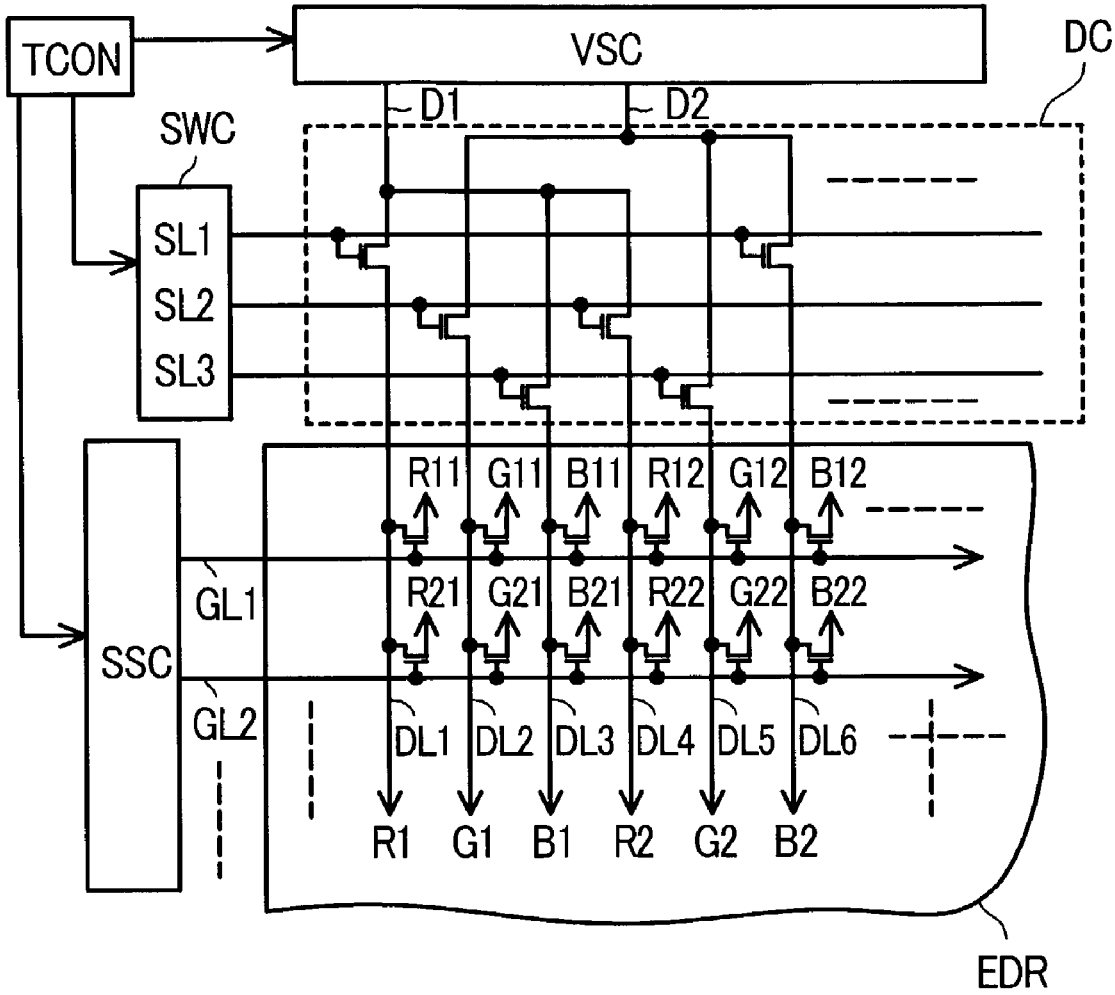
FIG. 5 is a schematic circuit diagram of an image display device according to Embodiment 4 of the invention.

FIG. 5 is a view corresponding to FIG. 1.

Embodiment 4 and Embodiment 1 shown in FIG. 1 differ in the construction of the distribution circuit DC.

In Embodiment 4, the output D1 is connected to the video signal lines R1, B1 and R2, and the output D2 is connected to the video signal lines G1, G2 and B2. Accordingly, video signals are outputted as follows:

D1→R1 and D2→B2 for SL1:ON, SL2:OFF and SL3: OFF;

D1→R2 and D2→G1 for SL1:OFF, SL2:ON and SL3: OFF; and

D1→B1 and D2→G2 for SL1:OFF, SL2:OFF and SL3: ON.

Figure 6:
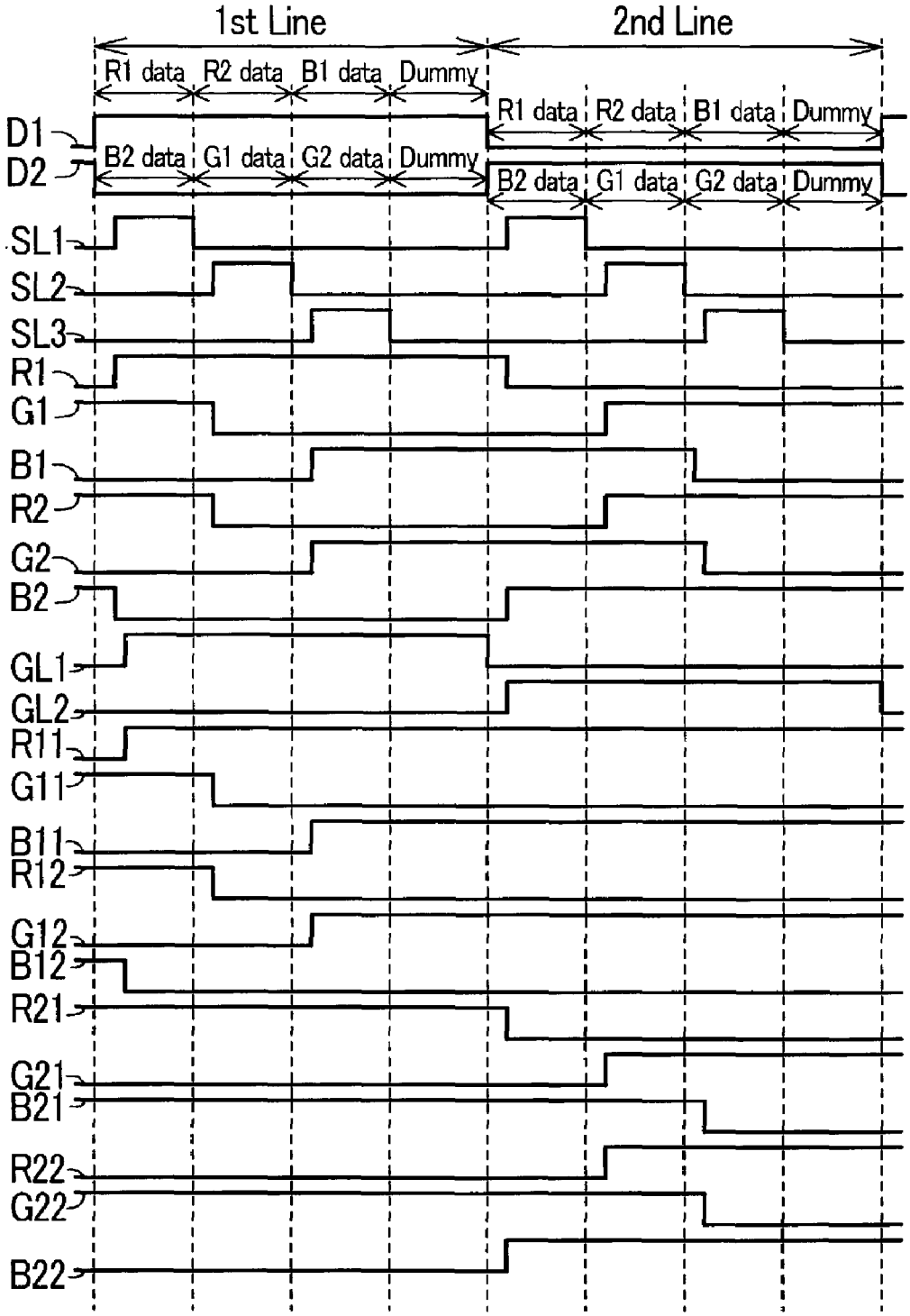
FIG. 6 is an explanatory view showing the signal polarity of the image display device according to Embodiment 4 of the invention.

FIG. 6 shows examples of essential signals.

In FIG. 6, there is shown that the polarity reversal of the adjacent output signals (represented by D1 and D2) from the video signal generation circuit VSC is realized between mutually adjacent pixels through the rearrangement of R, G and B data.

In this manner, a video signal can be written to each pixel so that the polarity of each pixel is reversed with respect to those of vertically and laterally adjacent pixels.

In addition, in Embodiment 4, since the transmission timings of R, G and B signals are averaged, the brightness of each color is not easily influenced by the writing characteristics of transistors within the respective pixels.

In this case, it is desirable that when a scanning signal is outputted from the same output terminal SL, video signals are always written to mutually adjacent unit pixels each of which includes three adjacent R, G and B pixels.

In Embodiment 4, the image display device is constructed so that video signals are always respectively written to mutually adjacent unit pixels each including three adjacent R, G and B pixels, in the following manner: R1 and B2 for SL1, R2 and G1 for SL2, and B1 and G2 for SL3.

Accordingly, the imbalance of signal writing between mutually adjacent pixels is prevented and the uniformity of signal writing between mutually adjacent pixels is realized.

In Embodiment 4 in particular, as shown in FIG. 6, when the scanning line GL is held at the ON level for the writing period of a plurality of colors, writing characteristics can be averagely improved for each of the colors compared to the construction shown in FIG. 1, whereby it is possible to restrain the occurrence of the brightness difference between the colors and fully achieve the advantage of improving the quality of signal writing.

(Embodiment 5)

Figure 7:
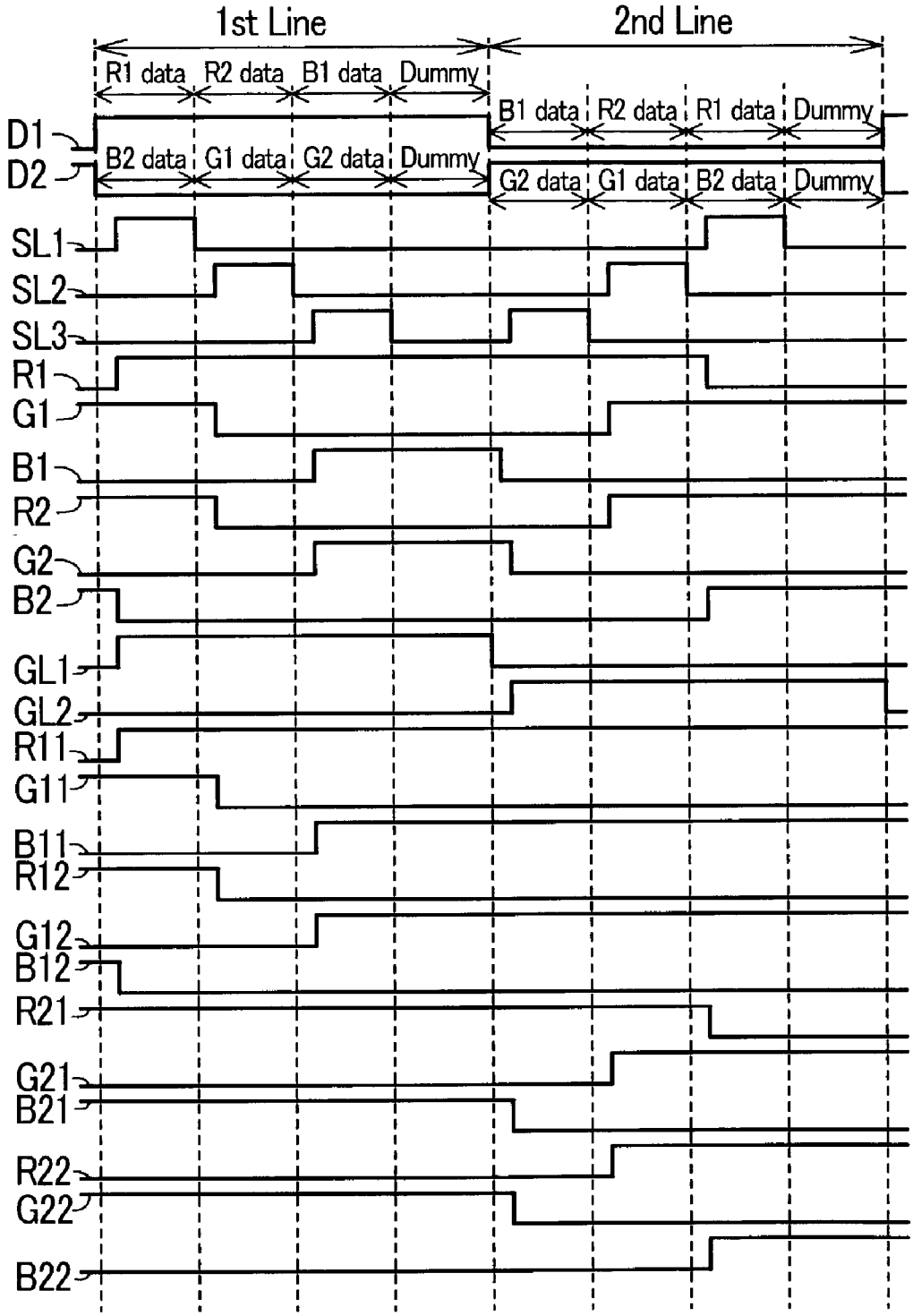
FIG. 7 is an explanatory view showing the signal polarity of an image display device according to Embodiment 5 of the invention.

FIG. 7 is a view based on the construction shown in FIG. 5, and corresponds to FIG. 6. In Embodiment 5, the order of transmission of video signals to the video signal lines DL from the video signal generation circuit VSC is changed in the construction shown in FIG. 5.

The order of colors creates conditions which are far more uniform on average, and even if a large part of the period transmission of colors is made a signal writing period, the writing period per each color and that per each pixel become uniform on average. Accordingly, it is possible to realize a further improvement in the brightness uniformity of the screen of the image display device and a further improvement in writing characteristics.

In the order of transmission of colors in Embodiment 5, signal writing is repeated in the same order in units of two lines. However, signal writing may also be repeated in units of three lines, two frames (FRM) or a plurality of frames (FRM).

(Embodiment 6)

Figure 8:
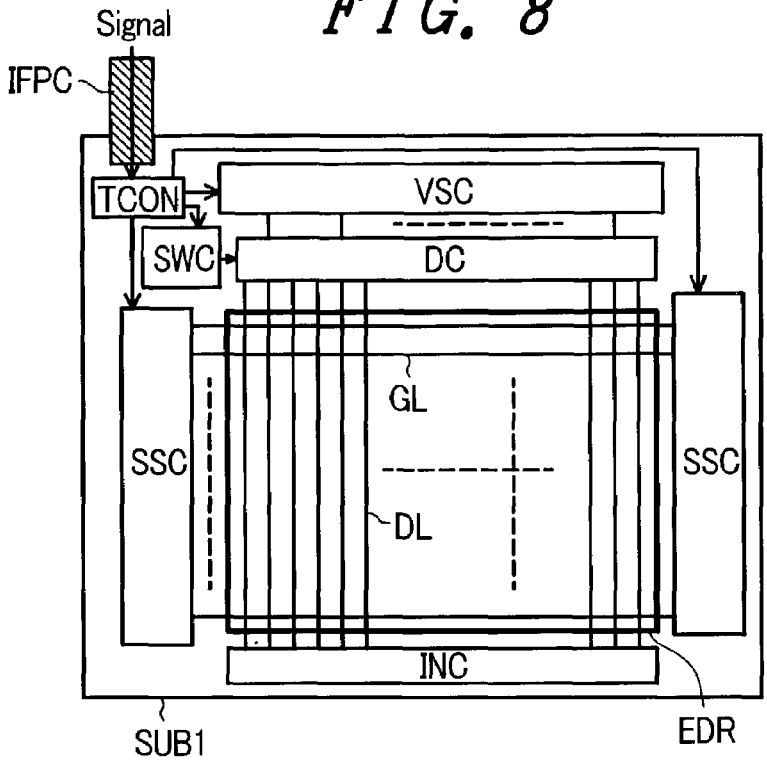
FIG. 8 is a view of the construction of an image display device according to Embodiment 6 of the invention.

FIG. 8 shows one embodiment of an image display device to which each of Embodiments 1 to 5 can be applied.

A signal from an external circuit is inputted to the timing converter TCON on the TFT substrate SUB1 through an input flexible printed circuit (FPC) IFPC. On the basis of the input signal, the timing converter TCON supplies appropriate signals containing a signal indicative of the rearrangement of the order of video signals to the switching circuit SWC, the scanning signal generation circuit SCC and the video signal generation circuit VSC in a timed manner.

In this manner, it is possible to realize an image display device to which each of Embodiments 1 to 5 can be applied.

In addition, an inspection circuit INC may be provided in an end portion of the TFT substrate SUB1 on the side opposite to the video signal generation circuit VSC. This inspection circuit INC is a circuit which can be mounted because the video signal generation circuit VSC needs only to be provided at one end of the TFT substrate SUB1 owing to each of Embodiments 1 to 5. The inspection circuit INC is one advantage of the invention, and can realize simplification of inspection.

(Embodiment 7)

Figure 9:
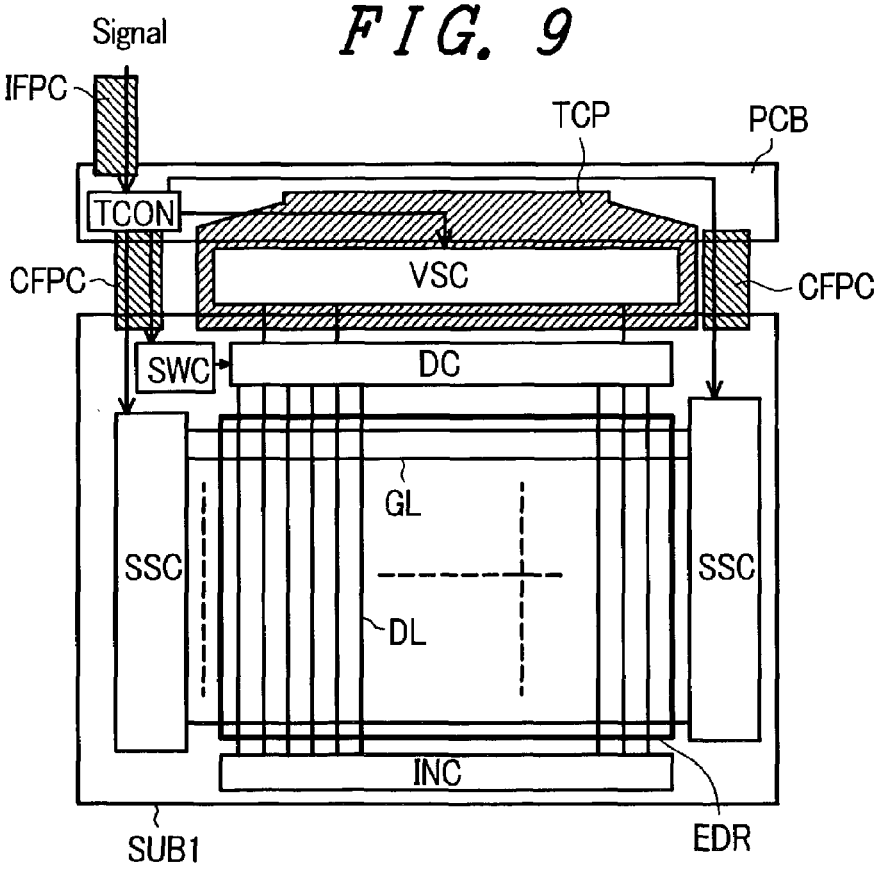
FIG. 9 is a view of the construction of an image display device according to Embodiment 7 of the invention.

FIG. 9 shows a view corresponding to FIG. 8.

In Embodiment 7, the timing converter TCON is provided on a printed circuit board PCB, and the printed circuit board PCB and the TFT substrate SUB1 are connected together by a connecting FPC CFPC to supply a signal to the scanning signal generation circuit SCC, and video signals are supplied from the video signal generation circuit VSC provided on a TCP.

According to this construction, Embodiments 1 to 5 can be applied to a related-art construction using a TCP. In addition, TCP-mounted drivers capable of dot inversion can be used for the video signal generation circuit VSC. Since general purpose products can be applied, a reduction in cost can be achieved.

Figure 10:
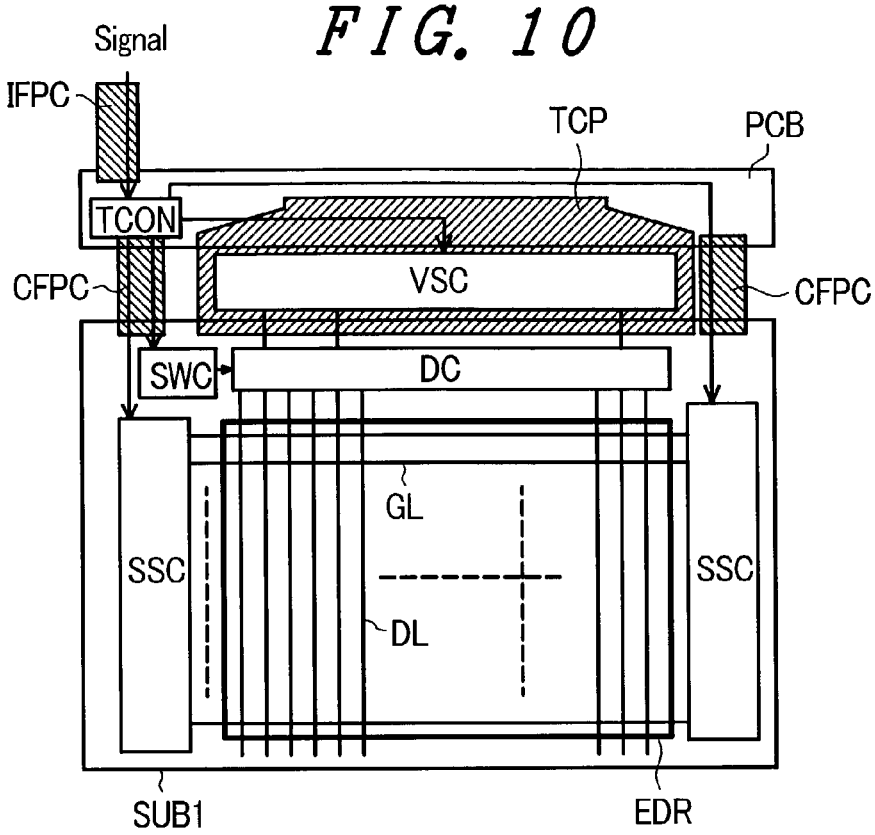
FIG. 10 is a view of the construction of another image display device according to Embodiment 7 of the invention.

As shown in FIG. 10, Embodiment 7 can also be applied to a construction that does not have the inspection circuit INC.

(Embodiment 8)

Figure 11:
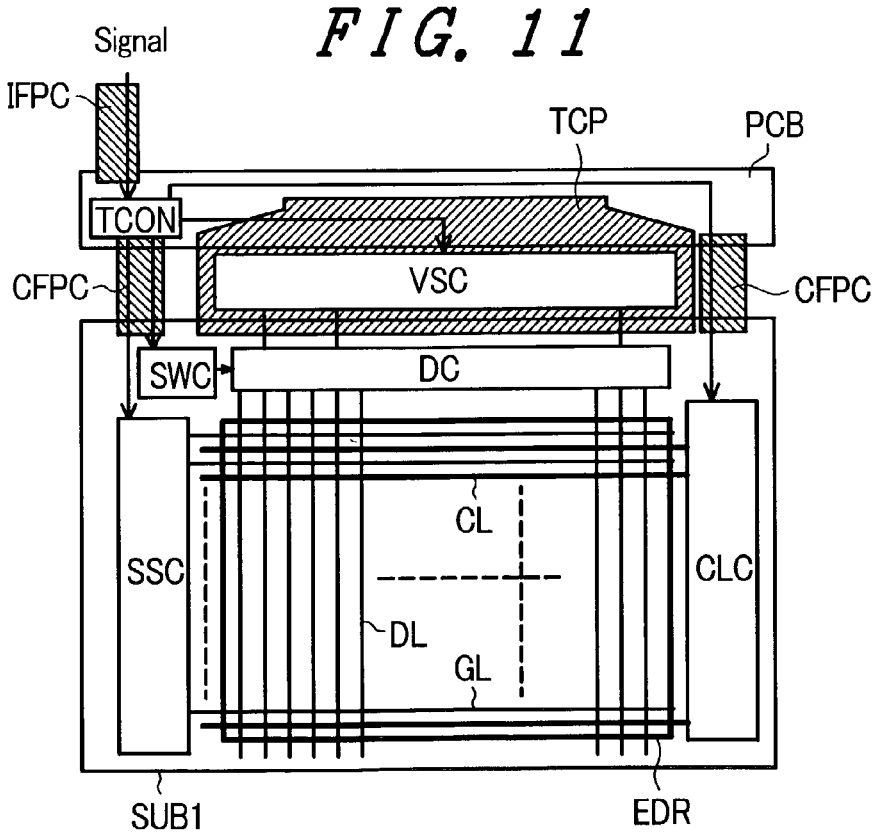
FIG. 11 is a view of the construction of an image display device according to Embodiment 8 of the invention.

FIG. 11 shows a case where the scanning signal generation circuit SCC is provided at only one end of the display area of the construction shown in FIG. 10 and a reference signal driver circuit CLC connected to reference signal lines CL is provided at the other end of the display area. Since reference signals can be controlled on line-by-line basis, the output voltage width of the video signal generation circuit VSC can be decreased and low-cost drivers can be used.

(Embodiment 9)

Figure 12:
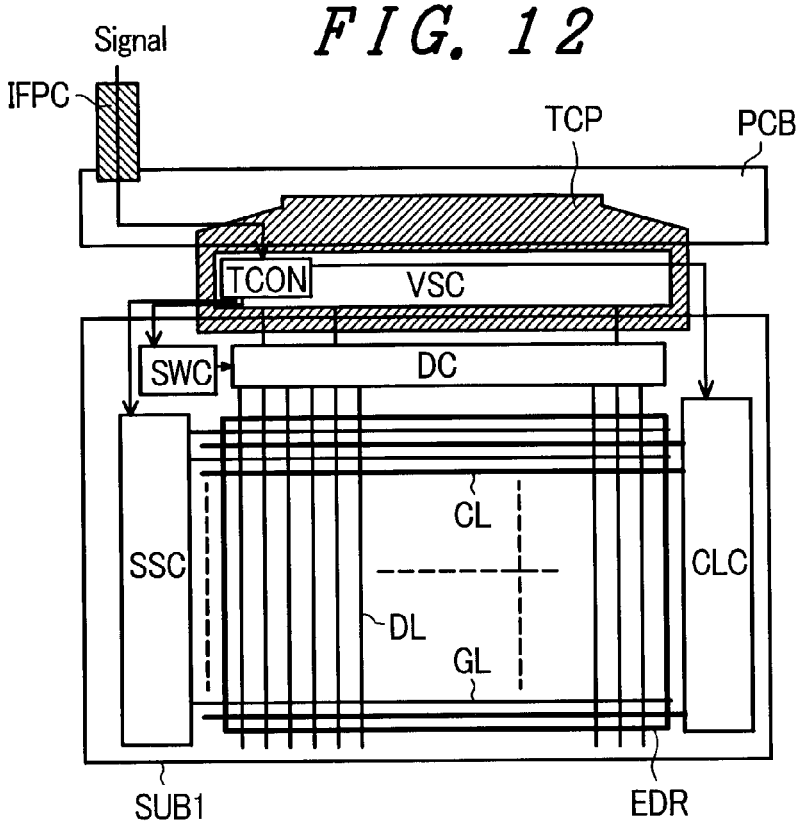
FIG. 12 is a view of the construction of an image display device according to Embodiment 9 of the invention.

FIG. 12 shows an example in which the timing converter TCON is built in the video signal generation circuit VSC. The timing converter TCON to serve as a TFT controller is a member with great fraction defective because of its large circuit scale. Accordingly, the timing converter TCON more greatly contributes to a reduction in cost owing to a greater improvement in total yield obtainable when it is provided outside the substrate than when it is formed of polysilicon on the substrate.

For this reason, in Embodiment 9, the timing converter TCON is built in the video signal generation circuit VSC made of semiconductor chips, as a function thereof.

Accordingly, since the number of semiconductor chips to be used per image display device is decreased, a decrease in the number of mounting processes is realized, whereby low cost and high yield are realized.

(Embodiment 10)

Figure 13:
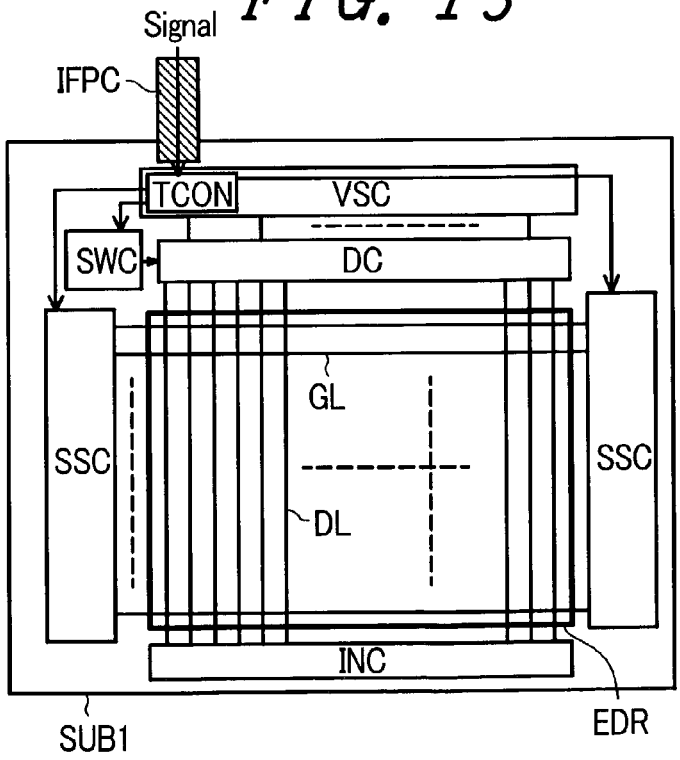
FIG. 13 is a view of the construction of an image display device according to Embodiment 10 of the invention.

FIG. 13 shows Embodiment 10 in which both the timing converter TCON and the video signal generation circuit VSC are formed of a high-performance semiconductor such as polysilicon on the TFT substrate SUB1.

In the case where a sufficiently high yield can be achieved, the number of parts to be externally attached can be minimized, whereby a far lower cost can be achieved.

In addition, since the input FPC IFPC is only a part disposed outside the TFT substrate SUB1, it is possible to reduce greatly the outside diameters of the display area of the image display device.

(Embodiment 11)

Figure 14:
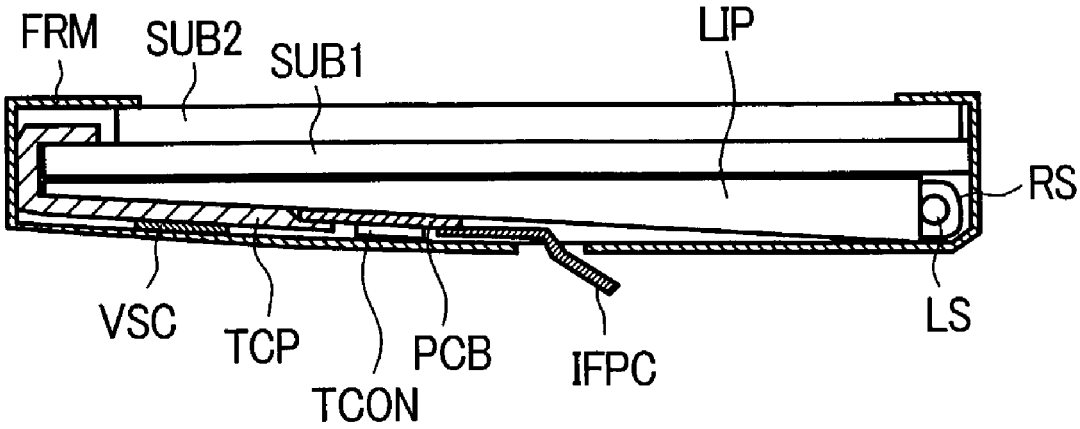
FIG. 14 is a cross-sectional view of the construction of an image display device according to Embodiment 11 of the invention.

FIG. 14 shows an example of the mounting structure of an image display device having any of the constructions shown in FIGS. 9 to 12, particularly, an example of the mounting structure of a liquid crystal display device.

A counter substrate SUB2 is disposed over the TFT substrate SUB1, and a light guide plate LIP is disposed under the TFT substrate SUB1. A light source LS and a reflector RS are disposed at one end of the light guide plate LIP to supply emitted light to the TFT substrate SUB1. A TCP on which the video signal generation circuit VSC is mounted is mounted at one end on one end portion of the TFT substrate SUB1, while the other end of the TCP is connected to the printed circuit board PCB on which the timing converter TCON is mounted, and the input FPC IFPC is connected to the printed circuit board PCB.

The TCP is disposed in the state of being folded to minimize its projection size from the TFT substrate SUB1. A box-like frame FRM for protection purposes is disposed to cover the outside of the above-described construction.

Figure 15:
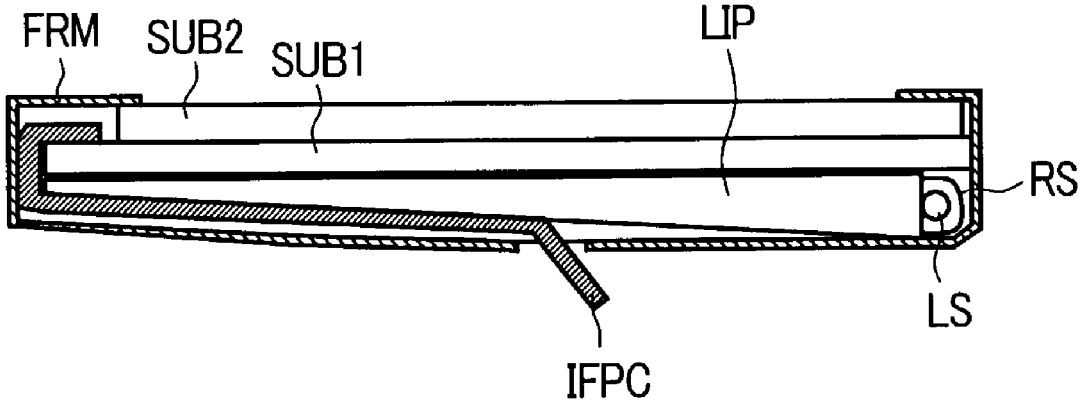
FIG. 15 is a cross-sectional view of the construction of another image display device according to Embodiment 11 of the invention.

FIG. 15 is a view based on each of the constructions shown in FIGS. 8 and 13, and corresponds to FIG. 14. As shown in FIG. 15, the TCP and the printed circuit board PCB are omitted to realize a great simplification of the construction.

Each of the constructions shown in FIGS. 14 and 15 uses the light guide plate LIP and the light source LS, but a self-luminous element such as an inorganic electroluminescent element or an organic electroluminescent element does not need the light guide plate LIP and the light source LS, whereby a reduction in the size of the image display device in the thickness direction can be realized.

(Embodiment 12)

Figure 16:
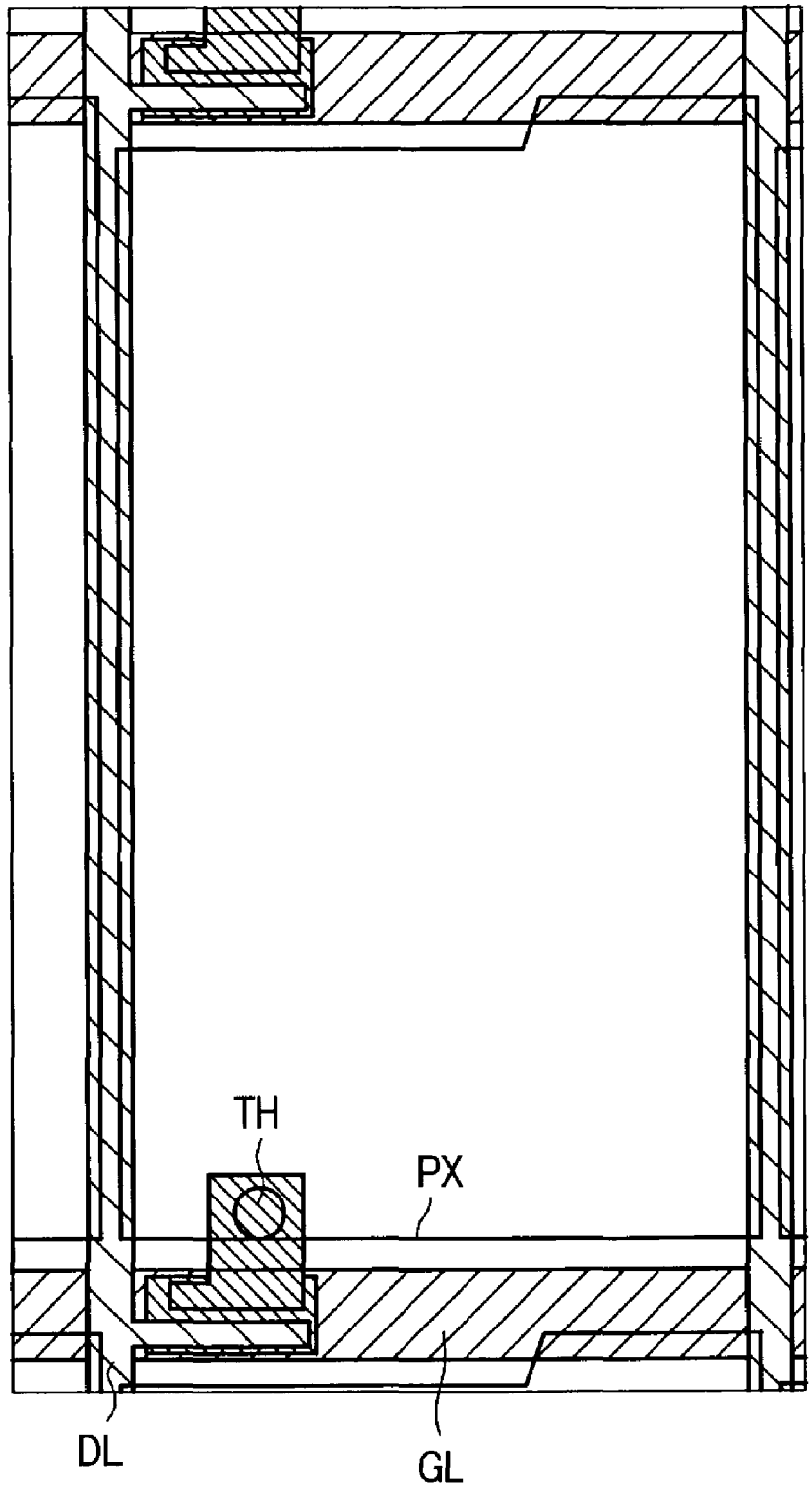
FIG. 16 is a schematic explanatory view of a pixel of one example of a liquid crystal display element for use in an image display device according to Embodiment 12 of the invention.
Figure 17:
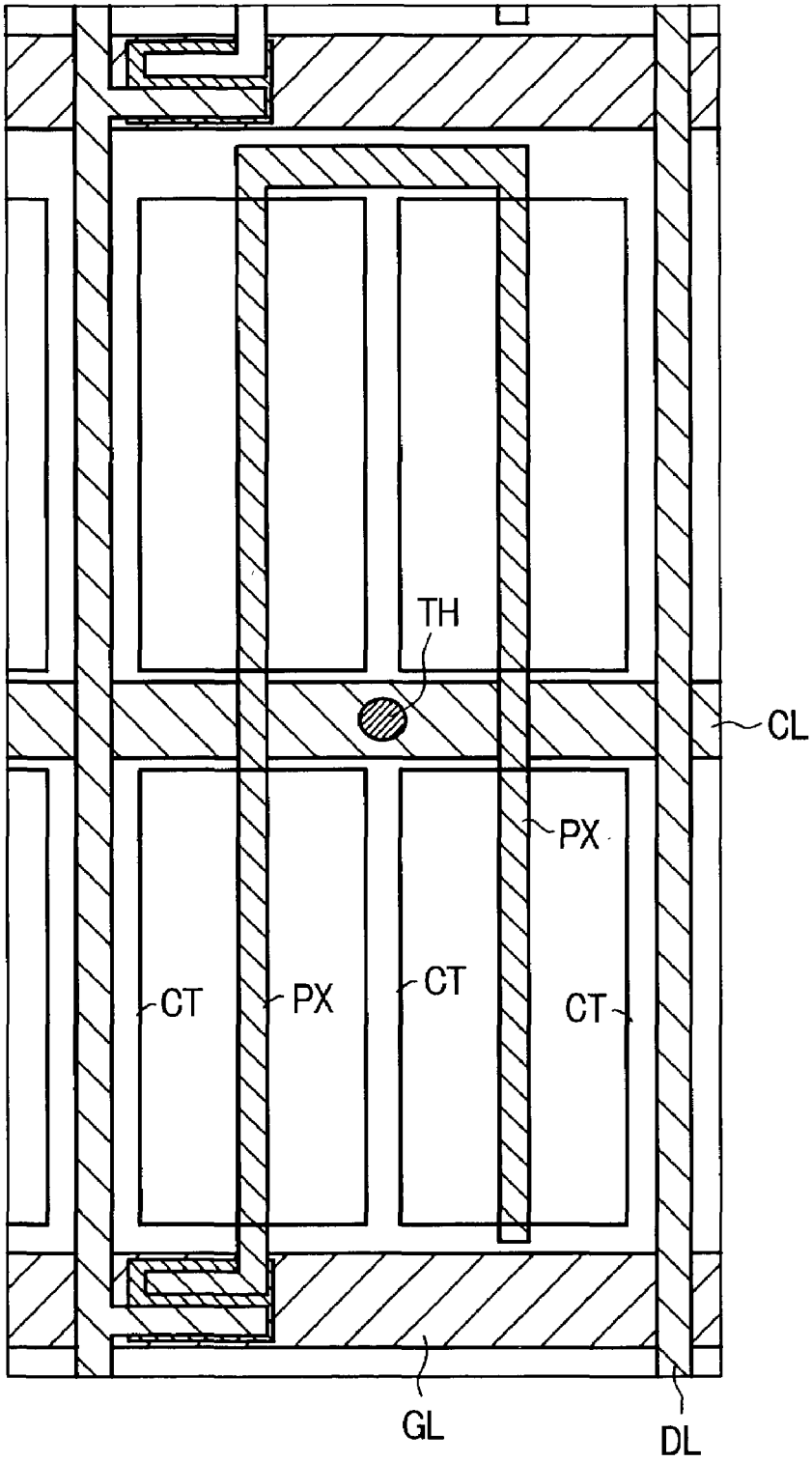
FIG. 17 is a schematic explanatory view of a pixel of another example of a liquid crystal display element for use in the image display device according to Embodiment 12 of the invention.

FIGS. 16 and 17 show different examples of a pixel to be applied to Embodiments 1 to 11. FIG. 16 shows an example of a so-called twisted nematic (TN) type liquid crystal display device, and FIG. 17 shows a modification of a so-called in-plane-switching (IPS) type liquid crystal display device.

Referring to FIG. 16, a gate signal line GL and a drain signal line DL are extended to intersect perpendicularly to each other, and a thin film transistor TFT is formed in the vicinity of the area of intersection of the drain signal line DL and the gate signal line GL. A signal from the thin film transistor TFT is transmitted to a pixel electrode PX through a through-hole TH. A reference electrode (not shown) is constructed on a counter substrate SUB2 (not shown), and a voltage difference is provided between the reference electrode and the pixel electrode PX to control the operation of a liquid crystal.

Referring to FIG. 17, electric fields having components parallel to substrates are formed between a reference electrode CT and a pixel electrode PX which are disposed on the same substrate, thereby driving a liquid crystal. This is why the construction shown in FIG. 17 is called an in-plane-switch mode.

Each of the constructions of Embodiments 1 to 11 can be used as an image display device by using either of these liquid crystal display elements shown in FIGS. 16 and 17.

(Embodiment 13)

Figure 18:
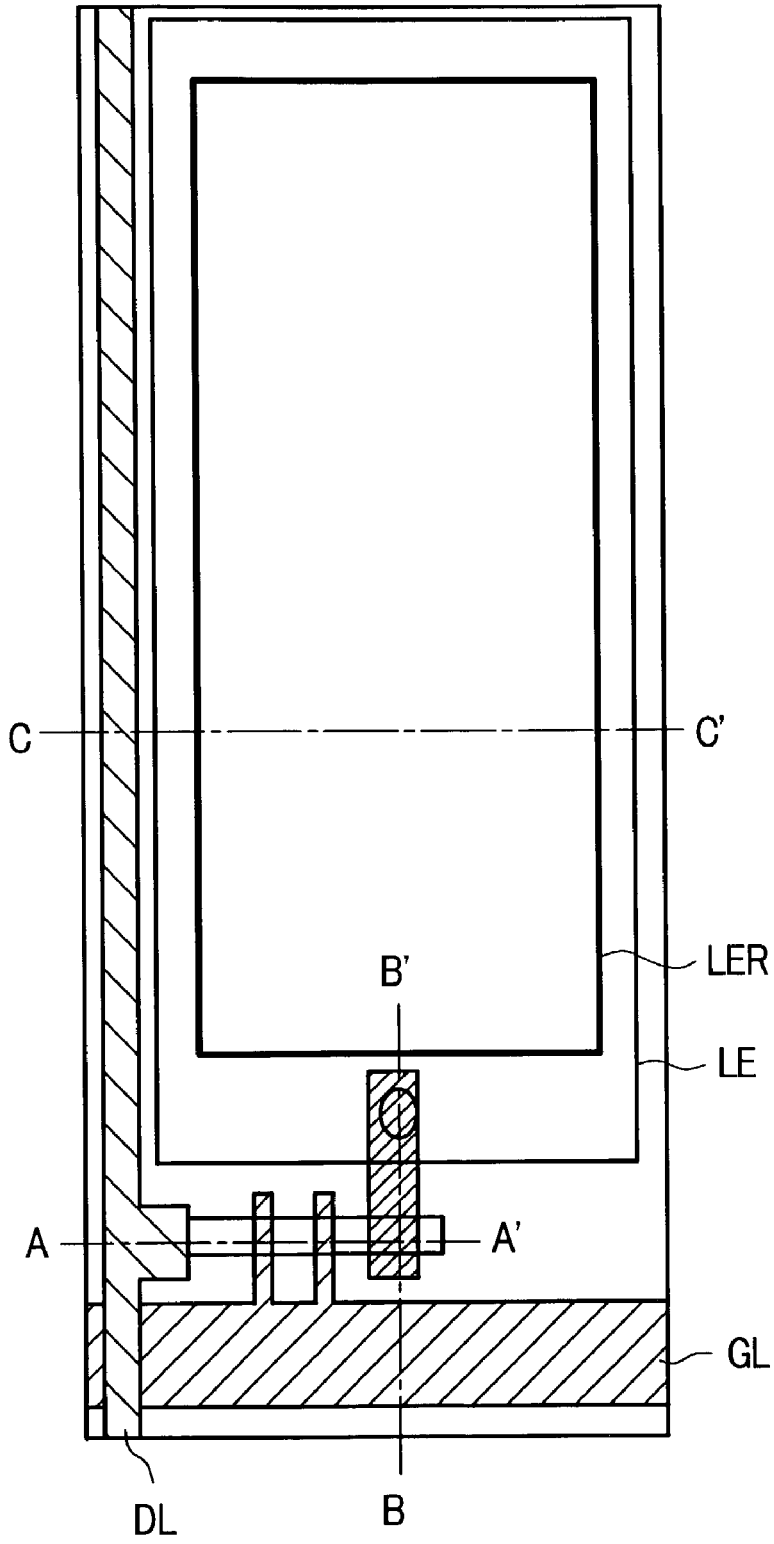
FIG. 18 is a schematic explanatory view of a pixel of a self-luminous element for use in an image display device according to Embodiment 13 of the invention.
Figure 19:
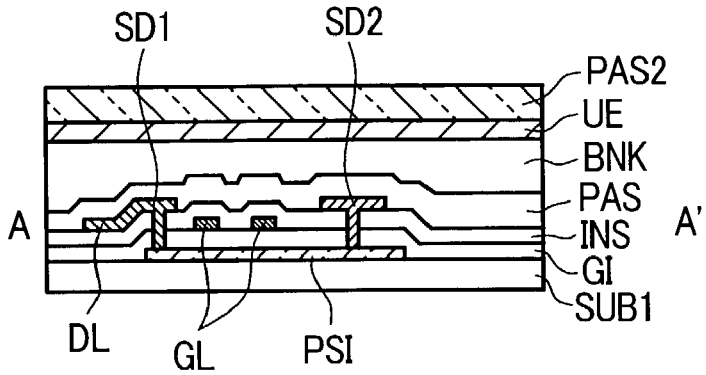
FIG. 19 is a cross-sectional explanatory view of the pixel of the self-luminous element for use in an image display device according to Embodiment 13 of the invention.
Figure 20:
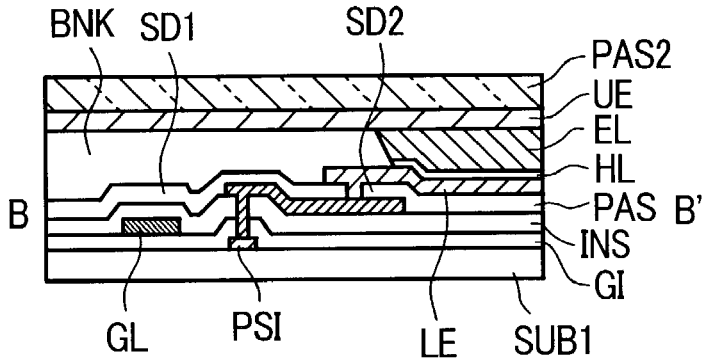
FIG. 20 is a cross-sectional explanatory view of the pixel of the self-luminous element for use in an image display device according to Embodiment 13 of the invention.
Figure 21:
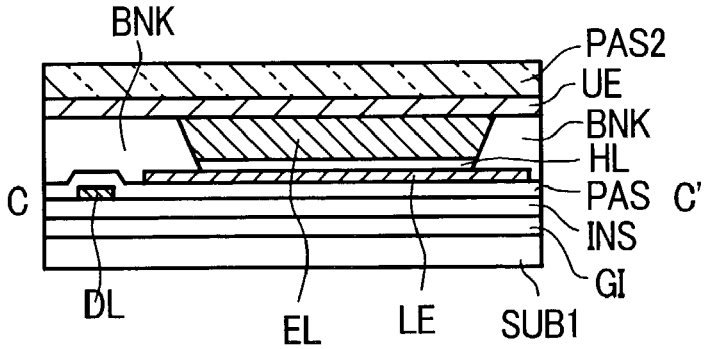
FIG. 21 is a cross-sectional explanatory view of the pixel of the self-luminous element for use in an image display device according to Embodiment 13 of the invention.

FIGS. 18 to 21 show an example of a pixel to be applied to Embodiments 1 to 11. FIG. 18 is a plan view, and FIGS. 19, 20 and 21 are schematic cross-sectional views taken along lines A–A', B–B' and C–C' of FIG. 18, respectively.

FIG. 18 shows an example of a self-luminous element, i.e., an example of an organic electroluminescent element. One example of the pixel structure of an organic electroluminescent element is shown in FIG. 18.

A polysilicon layer PSI is formed on a substrate directly or with an insulating film interposed therebetween. An gate insulating film GI overlies the polysilicon layer PSI, and a gate electrode GL is constructed on the gate insulating film GI.

After the gate electrode GL has been formed, ions are implanted so that the polysilicon layer PSI is made a low-resistance layer except a portion underlying the gate electrode GL.

A drain electrode SD1 integral with a drain signal line DL is connected to one end of the polysilicon layer PSI through a through-hole. A source electrode SD2 is connected to the other end of the polysilicon layer PSI through a through-hole. The source electrode SD2 is connected to a lower electrode LE.

As is apparent from FIG. 21, a luminous material is formed in a hole constructed in the pixel, and is clamped between the lower electrode LE and an upper electrode UE with a hole injection layer HL interposed therebetween.

The hole injection layer HL is provided for smoothing the supply of current to the luminous material layer EL. The hole is constructed by providing an area in which a bank film BNK is not formed. The luminous material layer EL of an organic material needs a film thickness. In terms of a reduction in cost, it is desirable to form the luminous material layer EL by a printing method, a thermal transfer method or an ink jet method. Of course, mask deposition may be employable.

The luminous material layer EL, when a current is passing therethrough, emits light by converting the electrical energy of the current to optical energy. One example of the light-emitting mechanism of the luminous material layer EL is realized in such a manner that its luminescence center is excited by the electrical energy and emits energy as optical energy, returning from its excited state to its ground stage. The luminous material layer EL, because it is electrically conductive, is short-circuited to an adjacent pixel when it comes into contact with the adjacent pixel. Accordingly, the bank film BNK is provided for making it easy to prevent such contact and at the same time to reduce a step size between a portion where the luminous material layer EL is formed and a portion where the luminous material layer EL is not formed.

The operation of this element will be described below. When the gate electrode GL goes to its ON state, a channel layer is formed under the gate electrode GL so that a current from the drain signal line DL flows to the source electrode SD2. The current passes from the lower electrode LE connected to the source electrode SD2 into the luminous material layer EL through the hole injection layer HL, and flows into the upper electrode UE. In this manner, luminescence is effected.

The display device can be realized in such a manner that at least one of the upper electrode UE and the lower electrode LE is formed as a transparent electrode so that light is emitted to the outside. Known examples of the material of the transparent electrode are ITO (Indium-Tin-Oxide), IZO (Indium-Zinc-Oxide), ITZO (Indium-Tin-Zinc-Oxide), $In_2O_3$ and $SnO_2$.

Organic electroluminescent elements are of a current-driven type different from a voltage-driven type such as liquid crystal display elements. Namely, organic electroluminescent elements control their luminescence through the amount of current. For this reason, if a bright image display device is to be obtained with such organic electroluminescent elements, a large amount of current needs to be supplied to the organic electroluminescent elements.

According to the construction of each of Embodiments 1 to 11, the amount of current for each color can be averaged, whereby reductions in color irregularity and brightness irregularity are realized. In addition, since a period during which the scanning line GL is held in the ON state is provided in addition to the dummy period, the period of current writing can be made longer to supply a larger amount of current to pixels, whereby a self-luminous image display device which is bright and free of color irregularity is realized.

As is apparent from the foregoing detailed description, according to the image display device according to the invention, since polarity is reversed between mutually adjacent pixels and the outside dimensions of an effective display area are reduced, it is possible to provide an image device which has low power consumption, reduced color irregularity, reduced brightness irregularity and superior writing characteristics. In particular, it is possible to provide a liquid crystal display device and an organic electroluminescent display device having such advantages.

What is claimed is:

1. An image display device comprising:

a video signal generation circuit;

a distribution circuit disposed after the video signal generation circuit for receiving outputs thereform, the distribution circuit having a first selection line, a second selection line, and a third selection line;

a first drain line connected to the video signal generation circuit and separated to R1, B1, G2 lines by the distribution circuit, the R1, B1, and G2 lines being arranged in order;

a second drain line connected to the video signal generation circuit and separated to G1, R2 and B2 lines by the distribution circuit, the G1 R2 and B2 lines being arranged in order;

a first switching element connected to the R1 line;

a second switching element connected to the B1 line;

a third switching element connected to the G2 line;

a fourth switching element connected to the G1 line;

a fifth switching element connected to the R2 line; and a sixth switching element connected to the B2 line, wherein the first drain line and the second drain line are pulled out to an identical side of the display device and arranged as neighboring drain lines, and at least two of following relations (1), (2), and (3) are satisfied:

(1) the first switching element connected to R1 line is controlled by one of the selection lines which is different from another one of the selection lines which controls the G1 line.

(2) the second switching element connected to B1 line is controlled by one of the selection lines which is different from another one of the selection lines which controls the R2 line.

(3) the third switching element connected to G2 line is controlled by one of the selection lines which is different from another one of the selection lines which controls the B2 line.

2. An image display device according to claim 1, wherein all of the relations (1), (2), and (3) are satisfied.

* * * * *